US009109365B2

(12) United States Patent
McCoy, Jr.

(10) Patent No.: US 9,109,365 B2
(45) Date of Patent: Aug. 18, 2015

(54) INSULATED COVER FOR ATTIC OPENINGS

(75) Inventor: George W. McCoy, Jr., Olathe, KS (US)

(73) Assignee: McCoy Building Products, LLC, Olathe, KS (US)

( * ) Notice: Subject to any disclaimer, the term of this patent is extended or adjusted under 35 U.S.C. 154(b) by 455 days.

(21) Appl. No.: 12/055,673

(22) Filed: Mar. 26, 2008

(65) Prior Publication Data

US 2009/0241434 A1 Oct. 1, 2009

(51) Int. Cl.
*E04F 11/06* (2006.01)

(52) U.S. Cl.
CPC ..... *E04F 11/064* (2013.01); *Y10T 24/32* (2015.01)

(58) Field of Classification Search
CPC ..... E04F 11/04; E04F 11/06; E04F 11/062; E04F 11/064; E04B 9/003; Y10T 24/32
USPC ..... 52/19, 200, 202, 203, DIG. 4, 404.1, 52/407.2
See application file for complete search history.

(56) References Cited

U.S. PATENT DOCUMENTS 4,179,144 A * 12/1979 Henderson ..... 292/202
4,299,059 A * 11/1981 Smith ..... 49/401
4,563,845 A * 1/1986 Stipe ..... 52/202
4,944,126 A * 7/1990 King ..... 52/202
5,330,386 A * 7/1994 Calandra ..... 454/341
5,481,833 A 1/1996 Williams
6,014,841 A * 1/2000 McCoy et al. ..... 52/19
6,601,352 B1 * 8/2003 Obermeyer et al. ..... 52/202
6,615,544 B1 * 9/2003 Tlemcani et al. ..... 49/7
6,625,933 B1 9/2003 Moeller
6,739,567 B1 * 5/2004 Curtis ..... 248/548
6,966,153 B2 11/2005 Panetta et al.
7,497,773 B1 * 3/2009 Schmidt ..... 454/354

OTHER PUBLICATIONS

A Do-It Yourself Guide to Energy Star Home Sealing, United States Environmental Protection Agency, Office of Air and Radiation, dated Sep. 2006 (2 pages).
Attic Access Technology Fact Sheet, Office of Building Technology, U.S. Department of Energy, Feb. 2000 (4 pages).
Attic Bypasses, Home Energy Guide Techniques Tactics & Tips, Minnesota Department of Commerce Energy Information Center, undated (3 pages).
Attic Tent The energy saving attic access insulator, www.attictent.com, website printout dated Dec. 25, 2007 (1 page).
(Continued)

*Primary Examiner* — Joshua J Michener
*Assistant Examiner* — Theodore Adamos
(74) *Attorney, Agent, or Firm* — Hovey Williams LLP

(57) ABSTRACT

An insulated cover for attic openings is provided which is adapted for pivotal mounting to the portion of the building surrounding the attic opening. The insulated cover includes cover structure for positioning in spanning relationship across the opening, a pivotal mount for enabling the cover to pivot from a spanning position enclosing the opening to an access-permitting position, and a magnetic coupler including a plurality of magnetic pairs for releasably holding the cover structure in position. The cover structure includes a recess for receiving a pullcord of the like, and a receiver adapted to couple with a rod for controlled pivoting of the cover structure and release of the magnetic connection between the magnetic pairs.

2 Claims, 8 Drawing Sheets

(56) References Cited

OTHER PUBLICATIONS

Clark Howard Does His Homework article by Sydney G. Roberts, Ph.D., date unknown (2 pages).
Custom-Made Ceiling Attic Access Door photograph, date unknown (2 pages).
Draft Cap the Attic Stair Insulator, www.draftcap.com, Owens Corning Foam Insulation, LLC, copyright 2007 Owens Corning, website printout dated Dec. 25, 2007 (3 pages).
Energy-Efficient Attic Ladder, Resource Conservation Technology, Inc., product sheet dated Oct. 2005 (1 page).
Pull-Down Stairs article by Dennis Creech, Home Energy, Mar./Apr. 2000 (1 page).
Rainbow Attic Stair, product information and specification sheets, hand dated Feb. 15, 2007 (2 pages).
The Energy Guardian, Energy Sentry Solutions, www.energysentrysolutions.com/content.html, website printout dated Nov. 8, 2004, 4 pages.
Therm-A-Lid Attic Pulldown Stairway Insulator, secure.lunaweb.net/thermalid/index.html, website printout dated Aug. 21, 2005 (4 pages).
Turnkey Millwork Access Doors and Dormer Doors, www.access-doors.net, website printout dated May 20, 2005 (2 pages).

* cited by examiner

INSULATED COVER FOR ATTIC OPENINGS

BACKGROUND OF THE INVENTION

1. Field of the Invention

The present invention relates to a cover which is adapted for mounting in covering relationship to an attic access opening in a building, and more particularly to a cover provided with a pivotal mounting structure and a plurality of magnetic couplers for releasably retaining the cover in a closed, covering position over the attic opening.

2. Description of the Prior Art

Most residential construction includes openings in the ceiling or walls in order to gain access to an attic space. Building codes often require that such openings be sufficient in dimension to permit a firefighter to pass unobstructed. The size of the openings thus would permit a great volume of heated or air conditioned air to pass therethrough but for a door, insert or the like. Because of the typically large difference in cleanliness, temperature and humidity between the attic and the living space, it is very desirable to prevent dust and drafts from passing through the opening.

Attic opening covers of varying complexity are known in the art. These include simple cutouts of wood or drywall to more sophisticated covers such as an electric shutter system installed for use with an attic fan. More recently, U.S. Pat. No. 6,014,841, the disclosure of which is incorporated herein by reference, was developed to provide an improved insulated cover for attic openings. While this cover had the advantage of snap-on installation and provided insulation to reduce thermal loss, it is believed an improved attic opening cover may be possible to provide greater ease of installation, use, and durability. Another type of insulating cover for attic openings is exemplified by the insulating cover shown in U.S. Pat. No. 6,966,153. This patent describes an insulating cover which is inserted into the opening from the attic side and is a unitary piece of material. While providing an insulating benefit, it is not readily accessible from the interior side of the structure, may interfere with ladders or other structures above the opening, and still requires trim carpentry to install trim around the opening in the ceiling wall to provide an acceptable appearance and protect sheets of drywall from damage.

SUMMARY OF THE INVENTION

These and other objects have been met by the insulated attic opening cover of the present invention. That is to say, the attic opening cover hereof not only provides insulation and limits air intrusion from attic spaces into normally occupied areas of a residence, but is easy to install and use, may be mounted horizontally, vertically or at angles therebetween depending on the location, and helps limit access to attic spaces by small children, especially when pull down stairs are positioned in the opening.

Broadly speaking, the attic opening cover apparatus of the present invention includes a cover structure, a pivotal mount for the cover structure, and magnetic couplers for holding the cover structure in a closed condition. Preferably, the cover apparatus includes a cover pull receiver and a pull rod for engagement therewith to facilitate pivoting of the cover structure between a covering position substantially parallel to the ceiling or wall adjacent the opening to a position whereby access to the opening may be gained.

More particularly, the cover structure is provided with an insulating body which has a pocket therein. The pocket helps to receive a pull cord normally provided with a pull-down stair unit coupled to the structure surrounding the opening.

This pocket helps to ensure a flush mounting and finished appearance while retaining the insulating properties and functionality of the stairs.

The cover structure is also preferably configured with a circumscribing shelf. Magnetic coupling pairs are positioned in the pocket, the pairs including at least one magnetic member and at least one member of a ferromagnetic material such that it is magnetically attracted to the magnetic member. One member of each pair is attached to the cover structure, and the other member of the pair is attached to the building structure surrounding the opening. Most preferably, a plurality of pairs are circumferentially spaced in the shelf about the perimeter of the opening to which the cover structure is to be attached, such that the cover structure is securely retained against the ceiling or wall surrounding the opening when in a closed position.

Additionally, a sealing element is preferably positioned between the insulating body and the edge of an exterior panel of the cover structure. This sealing element preferably extends the perimeter of the exterior panel to inhibit intrusion of air and particles therepast.

By the provision of a hinge element and pull rod, the cover of the present invention is particularly easy to use. Access to the attic or to stairs in the attic opening are easily gained by simply inserting a hook at the end of the rod into the ring, and pulling down on the rod, thus pivoting the cover from the closed position. The cord attached to the stairs then comes out of the pocket. The storage of the cord in the pocket not only reduces interference when one walks under the stairs, but also reduces the likelihood that children will be attracted to the cord and pull on it, thereby gaining access to the attic. The magnetic attachments provide good retention of the cover to the surrounding structure while remaining out of sight in normal use. This is advantageous not only in overhead applications, but also when access is provided in knee walls or other upright structures for gaining entry to the attic spaces.

DESCRIPTION OF THE PREFERRED EMBODIMENT

Figure 1:
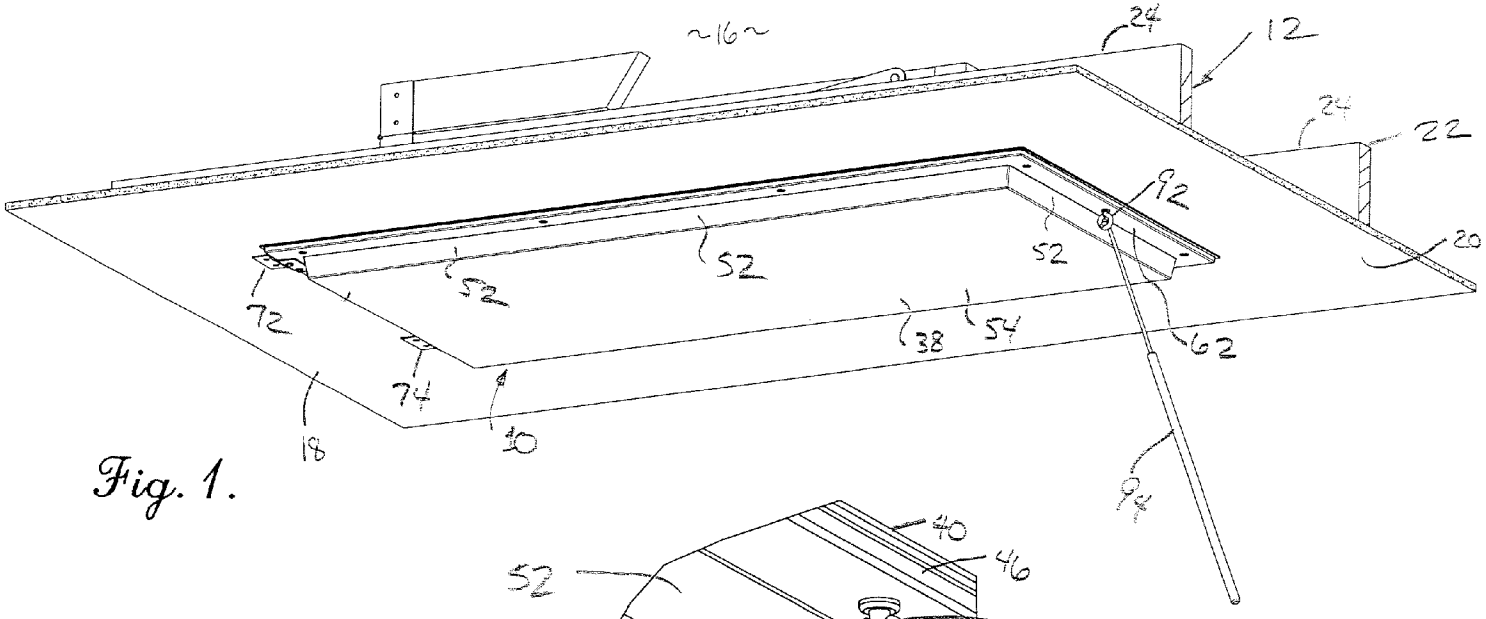
FIG. 1 is a bottom perspective view of an insulated cover for attic openings in accordance with the present invention, showing the cover structure positioned in covering relationship to an attic opening and stairway.
Figure 1A:
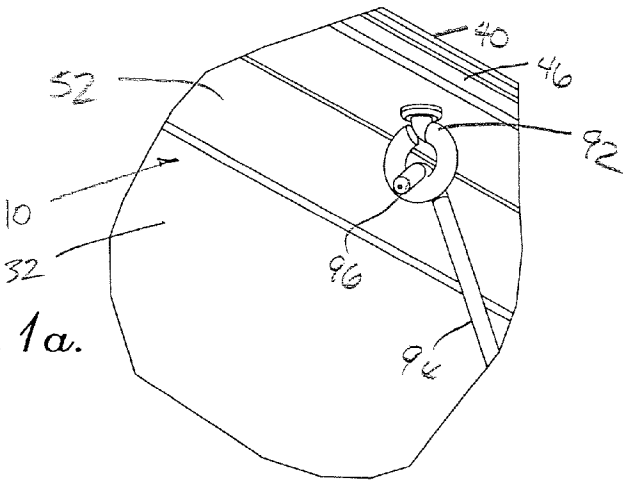
FIG. 1*a* is an enlarged perspective view of the attachment of a rod to an eye coupled to the cover panel of the cover structure shown in FIG. 1.

Referring now to the drawings, an insulated cover 10 for attic openings is provided for mounting to a building 12 to cover an opening 14 providing access to an attic 16. The building 12 includes a wall 18 having peripheral wall surfaces surrounding the opening 14. The wall 18, typically of sheathing such as gypsum board and also known as drywall, may be either a vertical wall such as a knee wall or, as shown, a ceiling wall 20. The building 12 typically includes frame members 22, and as illustrated in the drawings the frame members 22 may include ceiling joists 24 which mount a retractable attic stair assembly 26 positioned in the opening 14 overhead. The stair assembly 26 may include a backing panel 28 having a pullcord 30 which hangs down in order to pivot the stair assembly 26 downwardly on one or more hinges 31 or the like so that access may be gained to the attic 16.

The insulated cover 10 hereof broadly includes a cover structure 32, a pivotal mount 34 and magnetic couplers 36. The cover structure 32 is mounted by pivotal mount 34 so as to be normally positioned on the interior, finished portion of the building 12 and thus on the opposite side of the wall 18 separating the interior from the attic 16. The magnetic couplers 36 are positioned between and interconnect the cover structure 32 and the wall 18 in order to hold the cover structure in a closed position as shown in FIG. 1 while also permitting the cover structure 32 to be pivoted to the position of FIGS. 2, 3, 5 and 6 to gain access to the opening 14.

In greater detail, the cover structure 32 preferably includes a cover panel 38 of a lightweight, flexible material. While a variety of materials will serve, synthetic resin, such as high impact polystyrene, is a suitable material for the cover panel 38. The cover panel 38 is fabricated with a surrounding edge 40, an interior-facing side 42, and a back side 44 which when closed, faces opposite the attic opening 14. The cover panel 38 may be of any configuration, but most preferably the surrounding edge is rectangular (including square) in configuration. As better seen in FIGS. 8 and 9, the cover panel is molded to include a lip 46 which is positioned inboard of surrounding edge 40 and extends around the perimeter of the panel 38 to a continuous shelf 48. As viewed mounted to a ceiling as in FIG. 8, the lip 46 extends downwardly so that the shelf 48 is vertically below the edge 40 leaving a gap 50 between the shelf 48 and the wall 18. The configuration of the cover panel 38 to include the shelf 48 which provides gap 50 uniquely allows the surrounding edge 40 to lie in engagement with the wall 18 but still provide sufficient depth to permit the magnetic couplers 36 to be positioned in the gap 50 and thus between the wall 18 and the shelf 48. As a result, both the function and appearance of the insulated cover is enhanced.

Figure 8:
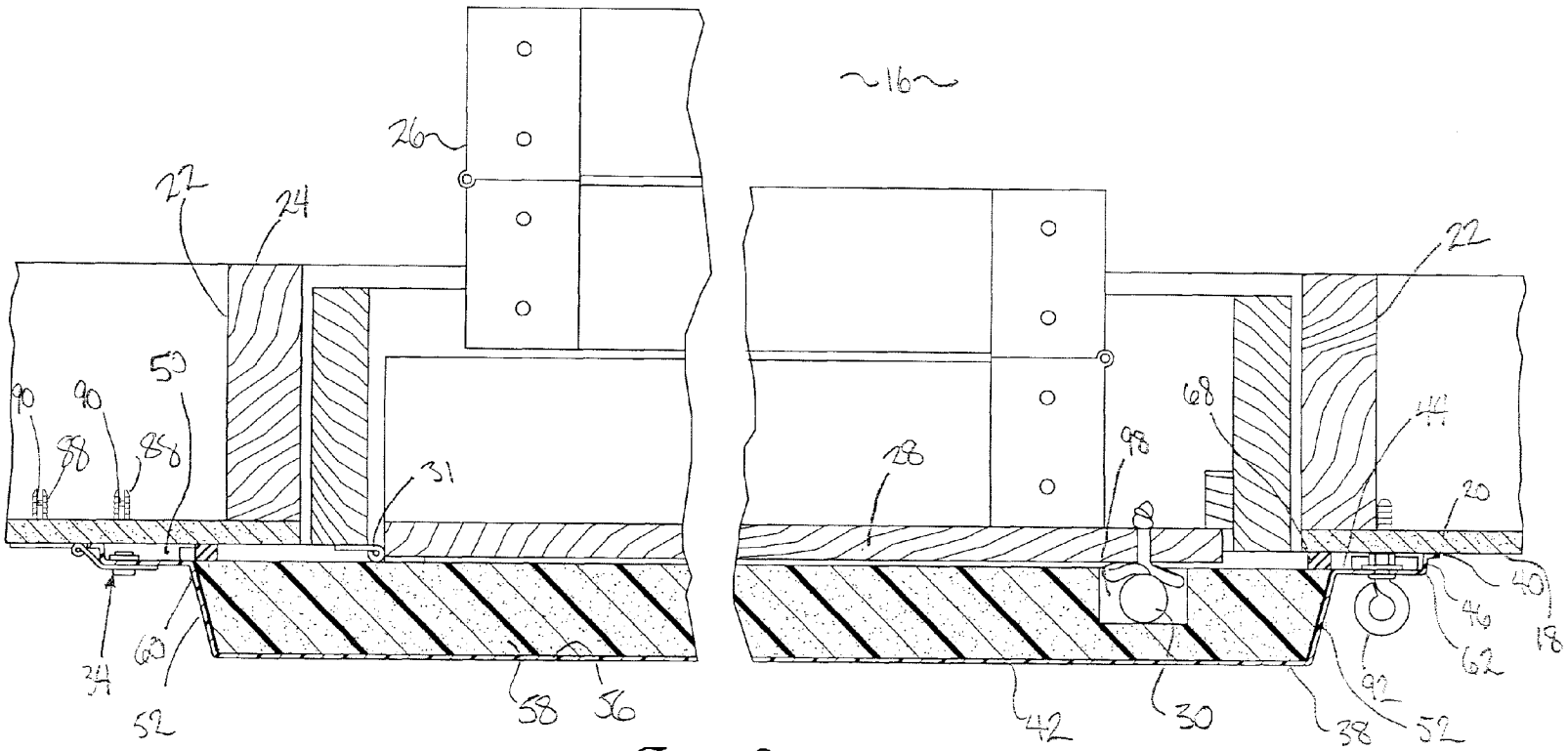
FIG. 8 is an enlarged vertical cross-sectional view taken along line 8-8 of FIG. 7 to show the pocket, pivotal mount and eye.

The shelf 48 extends continuously inboard of the surrounding edge 40 and then to a circumscribing, somewhat oblique sidewall 52 extending from the shelf 48 away from the lip 46. The sidewall 52, like the surrounding edge 40, is preferably rectangular in configuration and, with base 54 extending across and enclosing the sidewall 52, provides a well 56. The well 56 is configured to receive an insulating body 58 typically of synthetic resin such as, by way of example, extruded polystyrene foam board. The insulating body is of sufficient thickness to provide thermal and acoustic insulation, and sized along with the depth of the well so that the interior side 100 of the insulating body 48 is be recessed slightly below the plane of the surrounding edge 40. Such a recess or relief is provided to accommodate the backing panel 28 commonly included in stair assemblies. The shelf 48 of the cover structure 32 thus extends between the lip 46 and the sidewall 52, and when provided in a rectangular configuration, has a pivot end 60, a remote end 62, and first side 64 and second side 66. A substantially continuous seal 68 configured as a strip of elastomeric foam is mounted by adhesive or the like to the shelf 48 or, as shown in FIG. 8, to the insulating body 58 in a position to seal against the building 12, preferably the interior-facing side of the wall 18 and located at or closely proximate the gap 50 between the shelf 48 and the wall 18, in order to minimize drafts and the intrusion of dust or the like from the attic into the finished living space 70. The magnetic couplers 36 are selected, sized and positioned to cause the seal 68 to compress and thus provide a good sealing engagement against the wall 18.

Figure 2:
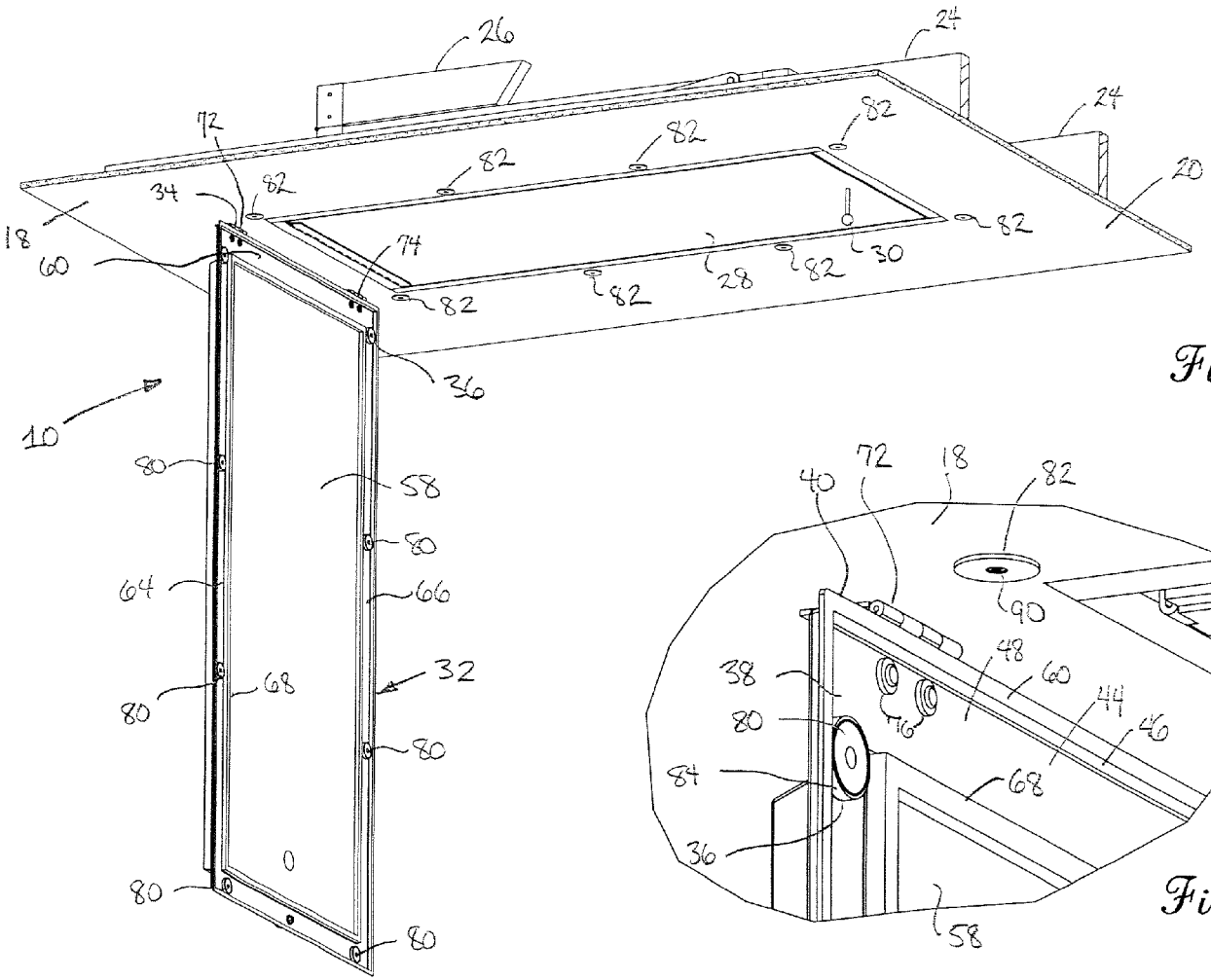
FIG. 2 is a bottom perspective view of the insulated cover of FIG. 1 when the cover structure is pivoted on the pivotal mount to show the bottom panel of the attic stair.
Figure 2A:
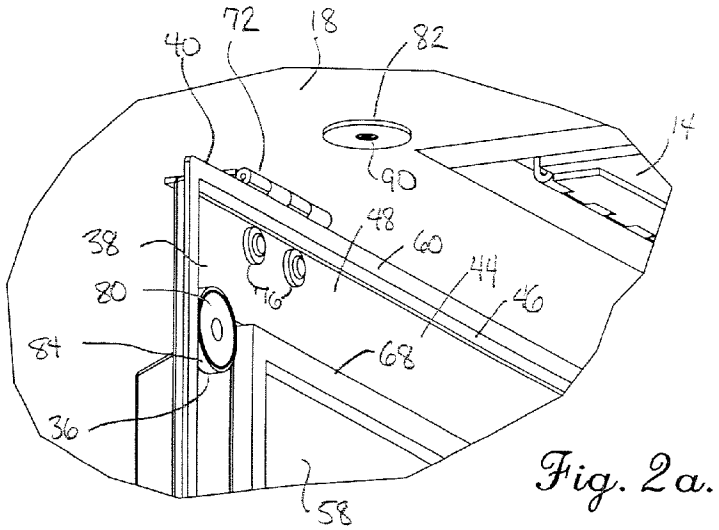
FIG. 2*a* is an enlarged perspective view of the insulated cover of FIG. 2, showing a magnetic coupler pair and one of the hinges of the pivotal mount.
Figure 3:
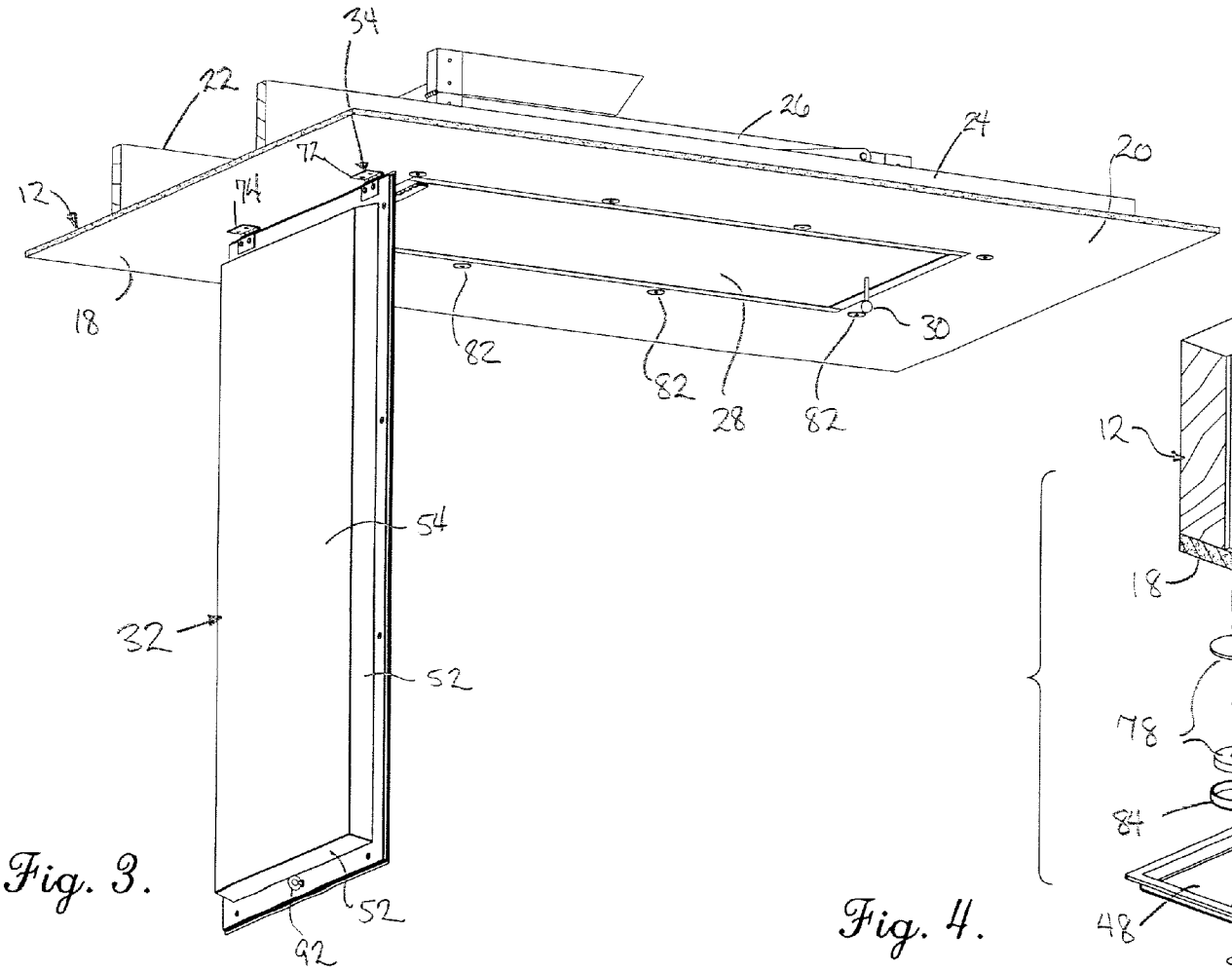
FIG. 3 is a bottom perspective view of the insulated cover of FIG. 2 showing the cover structure in a pivoted position.

The pivotal mount 34 preferably includes first and second hinges 72 and 74 which are mounted to the pivot end 60 of the shelf 48 in spaced, side-by-side, parallel relationship as shown in FIGS. 1, 2 and 3 so as to have a substantially common pivot axis. As shown in FIG. 2*a*, the center leaf of each of the hinges 72 and 74 is fastened by, for example, rivets 76 to the pivot end 60 of the shelf 48. The frame leaf of each of the hinges 72 and 74 is mounted to the building 12 by screws or other fasteners. The hinges 72 and 74 are positioned so that the cover panel 38 overlies the opening 14 with the seal outboard of the opening 14 so as to engage the wall 18.

Figure 4:
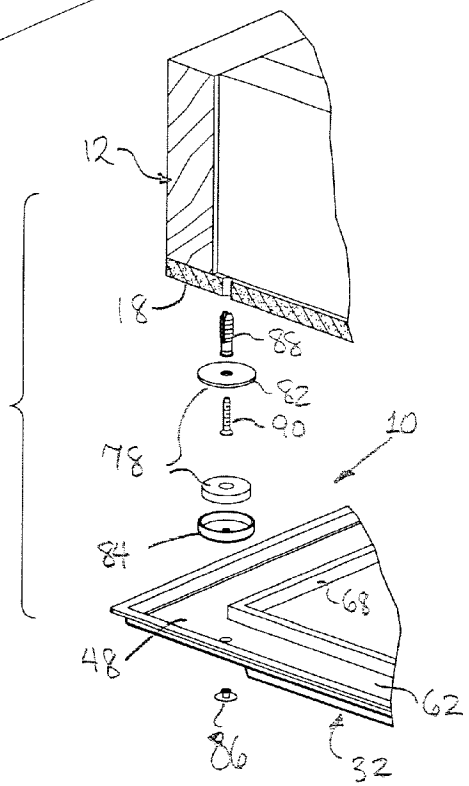
FIG. 4 is an enlarged, exploded view of the magnetic coupler positioned in the shelf of the cover structure and showing a sealing member positioned inboard thereof.
Figure 9:
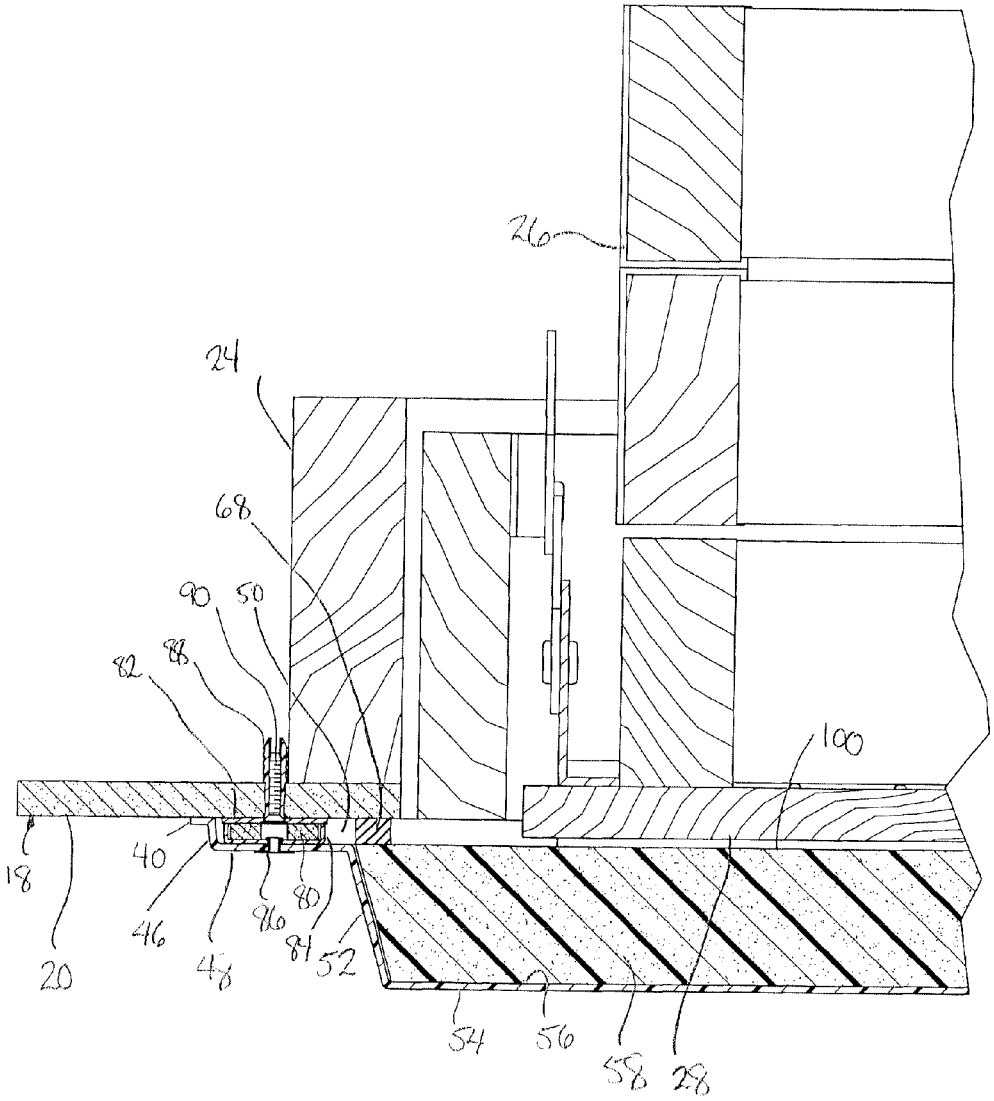
FIG. 9 is an enlarged vertical cross-sectional view taken along line 9-9 of FIG. 7 showing the positioning of the insulated cover relative to the attic stair assembly and attic opening.

Magnetic couplers 36 are shown in greater detail in FIGS. 2*a*, 4 and 9, and preferably include plural or multiple magnetic pairs 78, each pair including a magnetic body 80 and a ferromagnetic body 82 capable of magnetic attraction to the magnet 80. The magnetic pairs 78 are positioned between the interior side 42 of the covering structure and the peripheral surfaces of the wall 18 surrounding the opening 14 to releasably magnetically couple the covering structure 32 in spanning relationship across the opining 14. One body of each pair is fastened to the cover structure 32, with the other body of each pair fastened to the wall 18 of the building 12. As illustrated in the drawings, the magnetic body 80 is held by adhesive or other means to a housing 84 which is in turn attached by a rivet 86 or other fastener to the shelf 48 of the cover structure 32. Magnetic body 80 may be any type of magnet, but most preferably to provide good attachment between the cover structure 32 and the wall 18 without damaging either during withdrawal, a ceramic magnet having a strength of about 16 pounds has been found particularly useful. The ferromagnetic body 82 as used herein is a body of ferromagnetic material to which the magnetic body 80 has a magnetic attraction and thus magnetizable and may, but need not be, magnetic itself. If of magnetic material, ferromagnetic body 82 must be oriented so as to attract, rather than repel, the magnetic body 80. From an economic perspective, ferromagnetic body 82 may be of mild steel or other material which is inexpensive but subject to magnetic attraction (the wall 18 typically being of sheetrock or plaster and not being capable of magnetic attraction itself), and a steel body washer of a size compatible with the magnetic body 80 has been found useful in this regard. As shown in FIG. 4, a screw anchor 88 is placed in a corresponding hole drilled in registry with the rivet 86 when the cover structure is pivoted to a closed position. The ferromagnetic body 82 is then positioned and fastened in place by a screw 90 as shown in FIG. 9. The magnetic pairs 78 are spaced at intervals along the shelf 48 as shown in the drawings so that the cover structure 32 is held securely to the wall 18 with the seal 68 in engagement with the wall surrounding the opening 18 and the insulating body 58 extending across the opening as shown in FIGS. 8 and 9 to provide thermal and sound insulation. For example, a 2 inch thick insulating body of extruded polystyrene foam insulation will yield an insulating factor of about R-10 in the vicinity of the opening 14. Thus, while the hinges provide secure attachment for the cover structure 32 at the pivot end, preferably at least two magnetic pairs 78 are provided for positioning at the remote end 62 of the shelf 48 and two, three or more magnetic pairs 78 are provide in each of the first side 64 and the second side 66 of the shelf in order to position the seal and the insulating body 58 to effectively close the opening 14 when the cover structure 32 is pivoted shut to the position of FIGS. 1, 7, 8 and 9.

In preferred embodiments, hardware for pivoting the cover structure 32 is also provided at the remote end, such as a knob, handle, or most preferably, a retractor receiver 92 is coupled to the remote end 62 of the cover structure 32. The retractor receiver 92 may be a simple eyebolt mounted to the cover structure opposite the pivotal mount as shown in FIG. 8. An elongated rod 94 having a finger 96 at one end sized for receipt in the receiver 92 provides an economical and efficient device for reaching the receiver 92 and retracting or pulling the cover structure 32 away from the wall 18 and pushing or reattaching the cover structure to the wall. Further, the insulating body 58 is preferably provided with a recess 98 on the interior side 100 of the insulating body which is opposite the cover structure 32. The recess 98 reduces the thickness of the insulating body 58 in the area of the recess by about ½ and is positioned and configured to receive a pullcord 30 including the knob of stair assembly 26. The provision of the recess 98 not only helps in providing a closed and sealed condition for the cover structure 32, but helps to hide the pullcord 30 for appearance and to diminish the interest of small children.

Installation of the insulated cover 10 is surprisingly easy. The installer need only position the cover structure 30 so that the seal surrounds the opening 14, then mark through the hinge openings on the frame leaf for receipt of the screws holding the hinges 68 and 70. After the holes are drilled, the user threads screws through the frame leaf of the hinges and the cover structure 32 is then held by the hinges in the position shown in FIGS. 2, 3 and 5. The installer then marks the holes for receiving the screw anchors (if needed) and screws 90 holding the ferromagnetic bodies 82, and then mounts the ferromagnetic bodies 82 to the wall 18. The cover structure 32 is then pivoted into place in spanning relationship across the opening 14.

Figure 5:
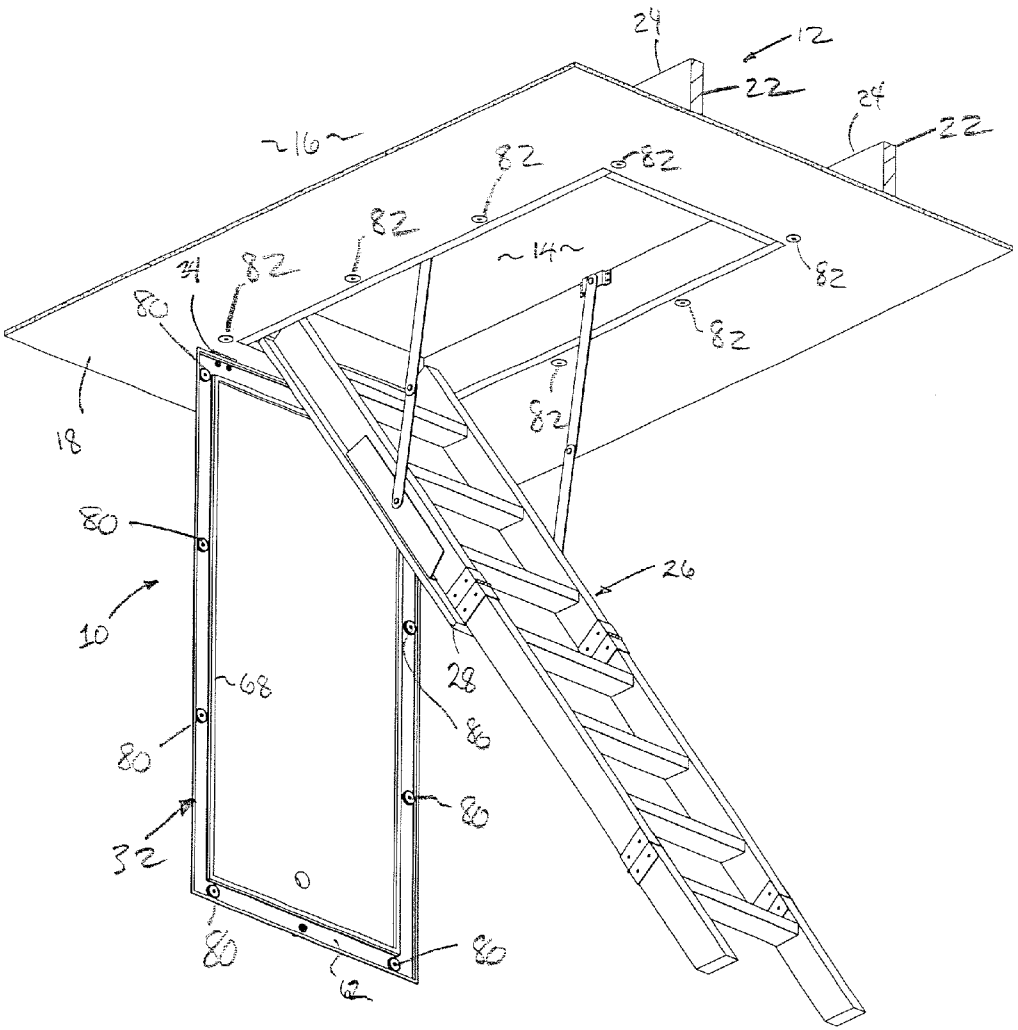
FIG. 5 is a bottom perspective view of the insulated cover similar to that shown in FIG. 2, showing an attic stair assembly pivoted to gain access through the attic opening.
Figure 6:
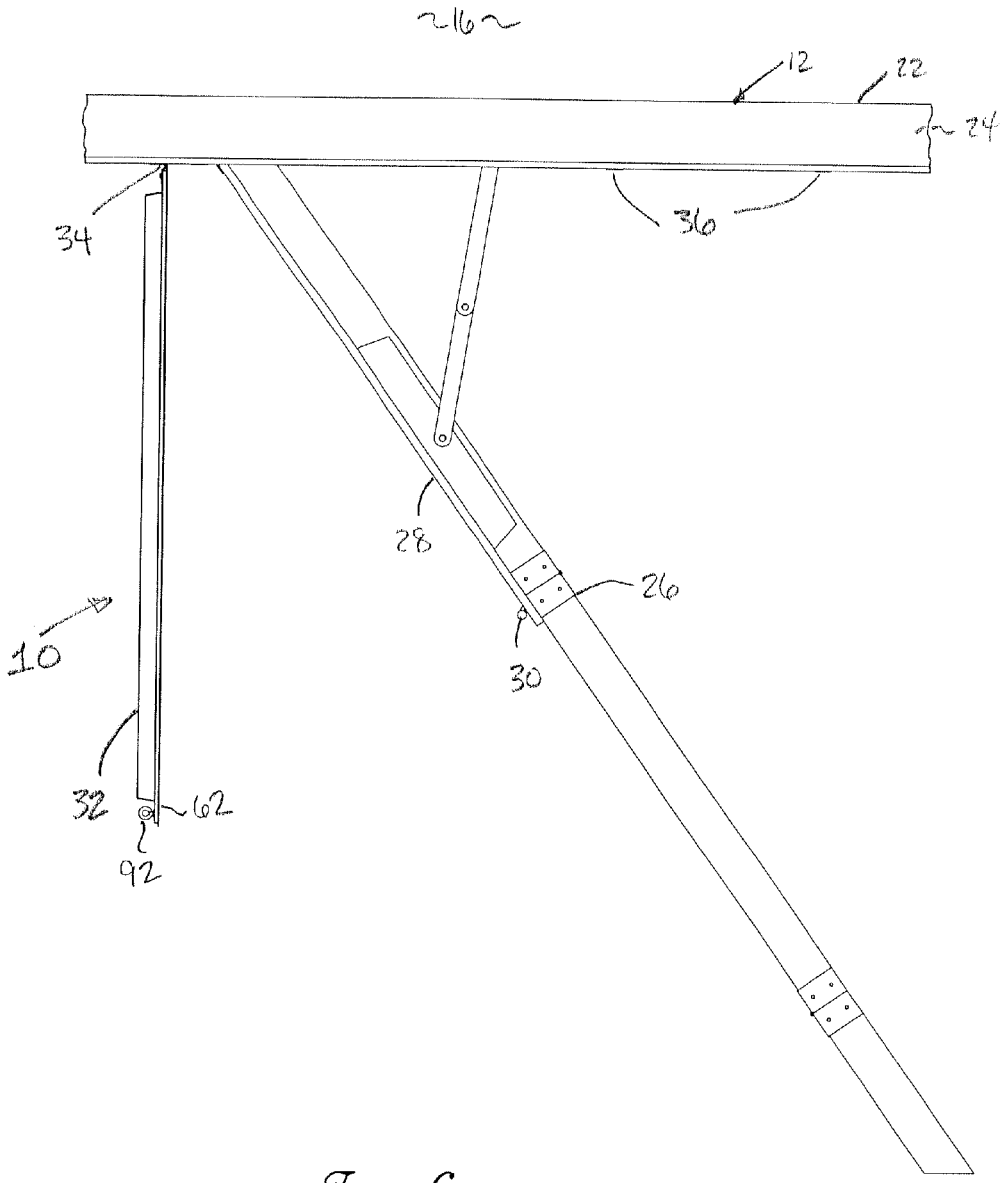
FIG. 6 is a side view of the insulated cover and attic stair assembly.
Figure 7:
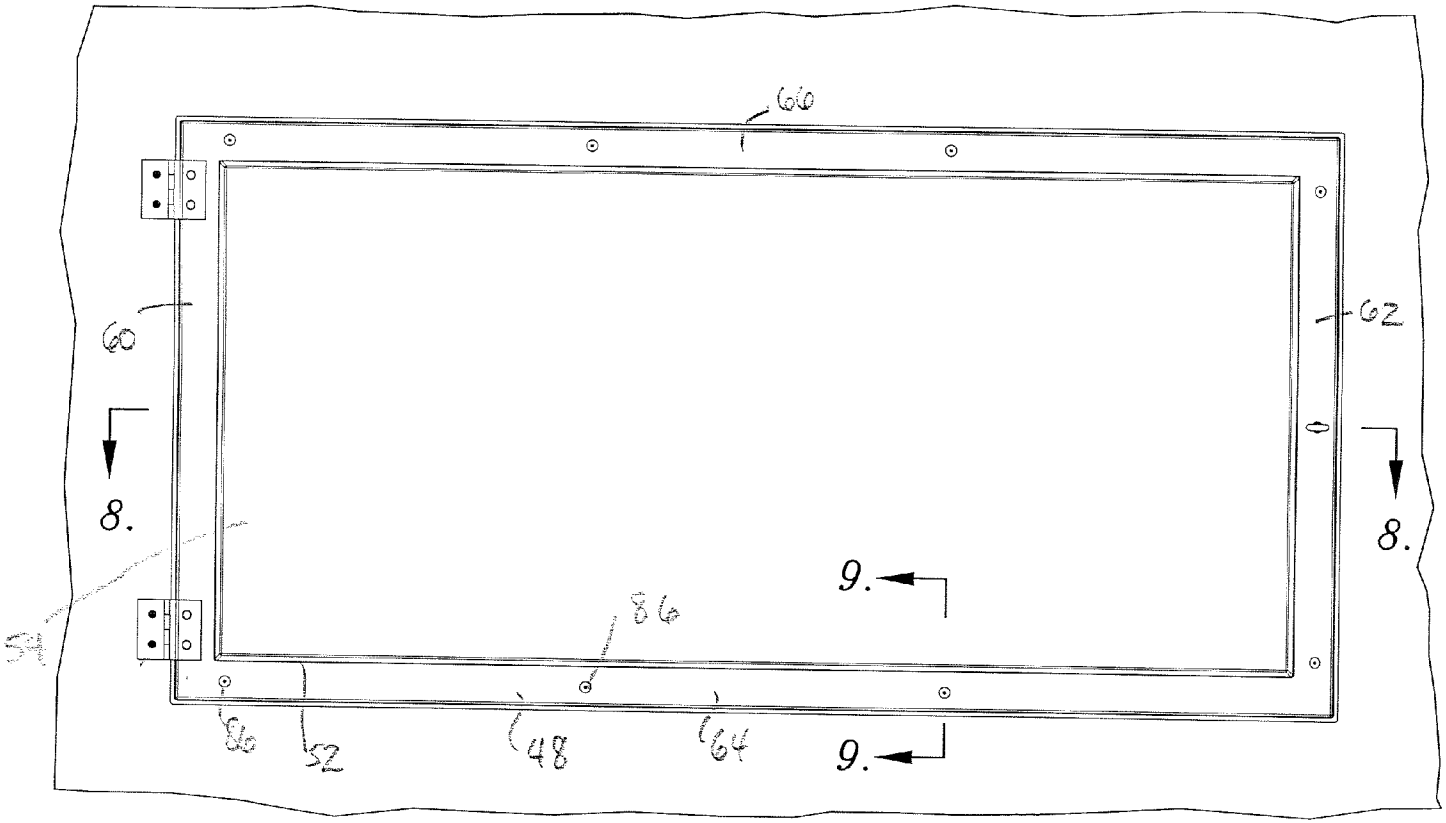
FIG. 7 is a bottom view of the insulated cover in a covering position as shown in FIG. 1.

The magnetic couplers 36 and the pivotal mount 34 hold the cover structure 32 in position on the interior side of the opening 14. The only protruding structure is the eyebolt of the retractor receiver 92. The distance from the floor in a ceiling application and the attraction between the magnetic bodies 80 and the ferromagnetic bodies is normally sufficient to discourage small children from attempting to gain access to the attic spaces. The owner may place the retraction rod in a place which is accessible only to adults. Then, placement of the finger of the rod into the retractor receiver 92 and a moderate downward pull is normally sufficient to pivot the cover structure 32 into an open condition as shown in FIGS. 2 and 3. The rod and retractor receiver 92 work together in a surprising way such that the application of a manual gripping force to the receiver 92 is typically insufficient to disengage the magnetic pairs, the use of the rod overcomes the magnetic attraction and permits controlled pivoting of the cover structure 32. The pullcord 30 then convenient drops so that the user may pull down the stair assembly as shown in FIGS. 5 and 6 and gain access to the attic though the attic opening.

Although preferred forms of the invention have been described above, it is to be recognized that such disclosure is by way of illustration only, and should not be utilized in a limiting sense in interpreting the scope of the present invention. As explained hereinabove, the insulated cover of the present invention is not limited to use in ceiling openings, but may also be used in attic openings through kneewalls as well, and the cover panel could be provided in components rather than as a unitary panel as described above. When placed in horizontal applications such as kneewalls, a knob or handle may be substituted for the receiver and rod arrangement described above by simply unthreading the eyebolt and substituting a handle or knob, if more convenient for that application. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

The invention claimed is:

1. An insulated cover apparatus adapted for positioning adjacent an attic opening within a wall and for selective closing of the opening, said wall having peripheral wall surfaces surrounding said opening and said opening being sufficiently dimensioned to permit passage of a firefighter therethrough, said insulated cover apparatus comprising:

a cover structure adapted for selective placement in covering relationship to the opening and including:

a panel having a surrounding edge and a shelf, said surrounding edge extending beyond the opening for positioning opposite the wall when the cover structure is in covering relationship to the opening, said shelf being located inwardly from said surrounding edge and recessed from said surrounding edge when said cover structure is in covering relationship to the opening, an insulating body positioned interiorly of the surrounding edge and having an interior side recessed from a plane of the surrounding edge, said insulating body having an interior-facing side including a recess, said recess being substantially surrounded by said insulating body and sized and positioned to receive a pullcord, and a substantially continuous sealing member positioned interiorly of the surrounding edge and for engagement with the wall when the cover structure is in a closed position spanning the opening;

a pivotal mount coupling the cover structure to the wall for pivotal movement between a first position closing the opening and a second position providing access to the opening;

at least one magnetic coupler for magnetically retaining the cover structure in a closed position spanning the opening, said magnetic coupler comprising a magnetic pair having:

a magnetic body coupled to said shelf of said panel, a ferromagnetic body; and a mechanical fastener complementally configured with said ferromagnetic body for connecting the ferromagnetic body to an interior side of the wall and configured for positioning the magnetic coupling within an area defined by the shelf between the surrounding edge and the insulating body when the cover structure is in a closed position spanning the opening.

2. An insulated cover apparatus adapted for positioning adjacent an attic opening within a wall and for selective closing of the opening, said wall having peripheral wall surfaces surrounding said opening and said opening being sufficiently dimensioned to permit passage of a firefighter therethrough, said insulated cover apparatus comprising:

a cover structure adapted for selective placement in covering relationship to the opening and including:

a panel having a surrounding edge and a shelf, said surrounding edge extending beyond the opening for positioning opposite the wall when the cover structure is in covering relationship to the opening, said shelf being located inwardly from said surrounding edge and recessed from said surrounding edge when said cover structure is in covering relationship to the opening, an insulating body positioned interiorly of the surrounding edge and having an interior side recessed from a plane of the surrounding edge, and a substantially continuous sealing member positioned interiorly of the surrounding edge and for engagement with the wall when the cover structure is in a closed position spanning the opening;

a pivotal mount coupling the cover structure to the wall for pivotal movement between a first position closing the opening and a second position providing access to the opening;

at least one magnetic coupler for magnetically retaining the cover structure in a closed position spanning the opening, said magnetic coupler comprising a magnetic pair having:

a magnetic body coupled to said shelf of said panel, a ferromagnetic body; and a mechanical fastener complementally configured with said ferromagnetic body for connecting the ferromagnetic body to an interior side of the wall and configured for positioning the magnetic coupling within an area defined by the shelf between the surrounding edge and the insulating body when the cover structure is in a closed position spanning the opening;

wherein said sealing member positioned on said cover structure inboard of said surrounding edge in surrounding relationship to the opening when the cover structure is in a closed position spanning the opening, said sealing member being positioned on said cover structure whereby said magnetic coupler is positioned between said sealing member and said surrounding edge, and wherein said sealing member is configured as a strip of elastomeric foam mounted to the interior side of said insulating body.

* * * * *